US009330859B2

(12) United States Patent
Biedunkiewicz et al.

(10) Patent No.: US 9,330,859 B2
(45) Date of Patent: May 3, 2016

(54) ROTOR FOR AN ELECTRIC SWITCH

(71) Applicant: Siemens Aktiengesellschaft, Munich (DE)

(72) Inventors: Pawel Biedunkiewicz, Berlin (DE); Jörg-Uwe Dahl, Werder (DE); Erhard Deylitz, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 34 days.

(21) Appl. No.: 14/332,470

(22) Filed: Jul. 16, 2014

(65) Prior Publication Data

US 2015/0060249 A1 Mar. 5, 2015

(30) Foreign Application Priority Data

Aug. 29, 2013 (DE) ..... 10 2013 217 255

(51) Int. Cl.
*H01H 3/32* (2006.01)
*H01H 1/20* (2006.01)
*H01H 73/04* (2006.01)

(52) U.S. Cl.
CPC ..... *H01H 3/32* (2013.01); *H01H 1/205* (2013.01); *H01H 1/2041* (2013.01); *H01H 73/045* (2013.01); *H01H 2235/004* (2013.01)

(58) Field of Classification Search
CPC ..... H01H 1/20; H01H 1/2041; H01H 1/205; H01H 73/045; H01H 77/102; H01H 11/00; H01H 3/32; H01H 2235/004; H01H 3/3052; H01H 1/2025; H01H 1/2058
USPC ..... 200/336, 243–250, 400, 401, 275, 17 R, 200/290; 29/622
See application file for complete search history.

(56) References Cited

U.S. PATENT DOCUMENTS

| | | | | |
|---|---|---|---|---|
| 5,281,776 | A | 1/1994 | Morel et al. | |
| 5,310,971 | A | 5/1994 | Vial et al. | |
| 7,977,592 | B2 * | 7/2011 | Shmukler | H01H 1/205 200/244 |
| 2006/0119455 | A1 * | 6/2006 | Park | H01H 77/104 335/16 |
| 2009/0065341 | A1 | 3/2009 | Shmukler et al. | |
| 2013/0140158 | A1 | 6/2013 | Dahl | |
| 2014/0061015 | A1 | 3/2014 | Biedunkiewicz et al. | |
| 2015/0060249 | A1 | 3/2015 | Biedunkiewicz et al. | |

FOREIGN PATENT DOCUMENTS

| | | | |
|---|---|---|---|
| DE | 69209972 | T2 | 10/1996 |
| DE | 69304374 | T2 | 2/1997 |
| DE | 102010035625 | A1 | 3/2012 |
| EP | 2704172 | A1 | 3/2014 |
| EP | 2846339 | A1 | 3/2015 |

OTHER PUBLICATIONS

European Search Report dated Feb. 5, 2015 issued in corresponding European Application No. 14172348.6.
German Office Action issued in German Patent Application No. 102013217255, dated Mar. 1, 2016.

* cited by examiner

*Primary Examiner* — Edwin A. Leon
(74) *Attorney, Agent, or Firm* — Harness, Dickey & Pierce, P.L.C.

(57) ABSTRACT

A rotor is disclosed for an electric switch. In an embodiment, the rotor includes a rotor housing and a rotatably mounted contact link, which has two movable contacts. In an embodiment, by rotation of the rotor, the two movable contacts are configured to interact with two stationary contacts of an electric switch so as to close or open a circuit. Further, the rotatably mounted contact link is mounted movably in the rotor housing in a direction perpendicular to the direction of the contact link in its closing position.

19 Claims, 8 Drawing Sheets

ROTOR FOR AN ELECTRIC SWITCH

PRIORITY STATEMENT

The present application hereby claims priority under 35 U.S.C. §119 to German patent application number DE 102013217255.9 filed Aug. 29, 2013, the entire contents of which are hereby incorporated herein by reference.

FIELD

At least one embodiment of the invention generally relates to a rotor for an electric switch.

BACKGROUND

Switching devices for switching electric currents typically comprise at least one contact system and further housing modifications. The contact system comprises an electric switch and serves to switch electric currents. A class of switching devices are the so-called "circuit breakers", which can typically switch currents of 100A or more.

These circuit breakers comprise a housing, in which the individual phases of the currents are switched. The individual phases of the currents can be accommodated in pole cartridges, which are enclosed by a dedicated housing. Moving and fixed contacts are accommodated in the pole cartridges, which moving and fixed contacts can be mechanically separated or brought together so as to switch off or on the currents. During separation of the moving and fixed contacts of a pole cartridge, an arc, which is typically quenched in a so-called "quenching chamber", is formed. Likewise, circuit breakers are known which do not contain any pole cartridges and which accommodate moving and fixed contacts in their housing.

In circuit breakers, it is necessary in order to achieve good current limitation to quickly build up a high arc voltage. This is achieved with so-called "double-break interrupters", which split the switching path twice and thus produce simultaneously two arcs in the event of a short circuit. The arc voltage produced by the arc is now present twice in the same time unit, which improves the current limitation in comparison with single-break interruption systems. Typically, in the case of so-called "double-break interrupters", two electrical contacts are arranged on a rotatably mounted contact link, which contacts represent the moving contacts. The two moving contacts interact with two fixed contacts of the electric switch so as to close or open the circuit.

DE 692 09 972 T2 describes a circuit breaker comprising single-pole units. In the case of this circuit breaker, the contact link of each pole cartridge is fitted in freely suspended fashion in a breaker shaft section, and the rigid mechanical connection between the individual breaker shaft sections is provided by two rods arranged parallel to the breaker shaft and eccentrically with respect to the rotary spindle thereof. This design ensures the application of the contact force, dynamic contact opening in the event of a short circuit of the electric switch and coupling to a switching mechanism for opening and closing the electric switch with an actuating lever.

DE 693 04 374 T2 discloses a circuit breaker comprising a mold housing with delay at the movement end of the contact link repulsion. The contact link is mounted without a spindle in the rotor housing. For this, the contact link comprises tension springs, which serve the purpose of ensuring, in the switch-on position of the circuit breaker, a force pressure exerted by the contact link on the stationary contacts and, at the same time, enable a rotation of the contact link under the action of the electrodynamic forces in the direction of the repulsion/switch-off position.

Double-break contact systems having a rotary design are very often susceptible to asymmetries. The asymmetries may be due to the tolerance zone position of the component parts or to the asymmetrical erosion during operation. For example, the contact pieces of the contact link can erode asymmetrically. These asymmetries result in uneven contact forces and contact resistances at the contact points. Previously known possible solutions for avoiding these asymmetries provide a possible way of compensation by virtue of the movable contact link and by virtue of a floating arrangement of the breaker shaft or the rotor in the pole cartridge.

SUMMARY

At least one embodiment of the invention provides a rotor for an electric switch comprising an alternative solution for compensating for asymmetries of its contact link.

In at least one embodiment, the rotor for an electric switch comprises a rotor housing and a rotatably mounted contact link, which comprises two movable contacts, wherein, by rotation of the rotor, the two movable contacts can interact with two stationary contacts of an electric switch so as to close or open a circuit. The rotatably mounted contact link is mounted movably in the rotor housing in a direction perpendicular to the direction of the contact link in its closing position. It is advantageous here that the contact forces can be balanced out more effectively than in conventional solutions; this is also the case in the case of considerable asymmetries as a result of tolerances and erosion. Asymmetrical contact resistances are reduced and it is ensured that there is even erosion on the load side and on the connection side of the electric switch.

BRIEF DESCRIPTION OF THE DRAWINGS

Embodiments of the invention will be described below with reference to the appended figures.

DETAILED DESCRIPTION OF THE EXAMPLE EMBODIMENTS

Figure 1A:
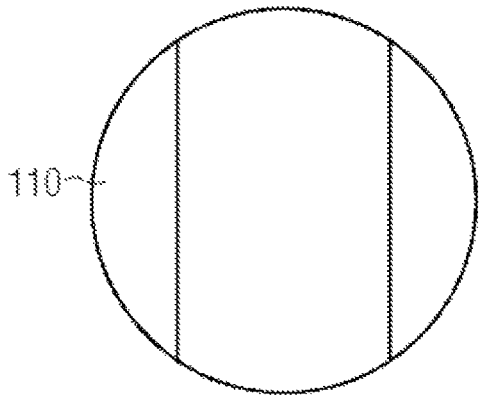
FIGS. 1A, 1B, 1C show rotor housing, contact link and contact link mounted in floating fashion.

Various example embodiments will now be described more fully with reference to the accompanying drawings in which only some example embodiments are shown. Specific structural and functional details disclosed herein are merely representative for purposes of describing example embodiments.

The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In at least one embodiment, the rotor for an electric switch comprises a rotor housing and a rotatably mounted contact link, which comprises two movable contacts, wherein, by rotation of the rotor, the two movable contacts can interact with two stationary contacts of an electric switch so as to close or open a circuit. The rotatably mounted contact link is mounted movably in the rotor housing in a direction perpendicular to the direction of the contact link in its closing position. It is advantageous here that the contact forces can be balanced out more effectively than in conventional solutions; this is also the case in the case of considerable asymmetries as a result of tolerances and erosion. Asymmetrical contact resistances are reduced and it is ensured that there is even erosion on the load side and on the connection side of the electric switch.

In one configuration, the rotatably mounted contact link is mounted movably in the rotor housing in a direction perpendicular to the rotary spindle of the contact link.

In a further configuration, the rotor for an electric switch furthermore comprises a first plate in the interior of the rotor, which first plate is arranged substantially parallel to the contact link, two pairs of first and second spring pins, and two pairs of first and second springs. The first ends of the respective spring pairs are fastened on the first spring pins, and the first spring pins rest on the contact link and the first plate, the second ends of the respective spring pairs are fastened on the second spring pins, and the second spring pins on the first plate, with the result that, in the closing position of the rotor, a minimum contact pressure of the movable contacts of the contact link on the stationary contacts is ensured, wherein the second spring pins are mounted movably in the rotor.

In one configuration of at least one embodiment, the rotor for an electric switch furthermore comprises a second plate in the interior of the rotor housing, which second plate is arranged substantially parallel to the contact link and to the first plate, wherein the first spring pins rest on the contact link and the first and second plates, and wherein the second ends of the respective spring pairs are fastened on the second spring pins and the second spring pins on the first and second plates.

In one configuration of at least one embodiment of the invention, the two pairs of first and second springs are in the form of tension springs.

In a further configuration of at least one embodiment of the invention, the plates and the contact link have a central cutout, through which a guide pin, acting as rotary spindle of the rotor, is guided.

In one configuration of at least one embodiment of the invention, the guide pin acts as rotary spindle of the rotor and comprises a first rotor pin, a second rotor pin and a centering spring.

The first rotor pin and the second rotor pin are connected to the rotor housing, and the centering spring can pass between the two rotor pins. The contact link is held by the centering spring. The centering spring is in the form of a tension spring with a coiled spring body without any spring eyelets.

In one configuration, the spring constant of the centering spring is designed in such a way that it can support the mass of the contact link in order to center the contact link in the rotor housing. The spring constant of the centering spring can be designed in such a way that the centering spring does not provide a high degree of force in opposition to asymmetry balancing of the contact link.

In a further configuration of at least one embodiment of the invention, the first rotor pin and the second rotor pin are connected to one another via a fixed central part.

The diameter of the centering spring can be so great in comparison with the diameter of the fixed central part that the contact link held by the centering spring can affect asymmetry balancing of the contact link until the centering spring stops against the central part.

In one configuration of the rotor, the first rotor pin, the second rotor pin and the fixed central part are formed integrally.

The rotor according to at least one embodiment of the invention can be part of an electric switch, which additionally comprises two stationary contacts, wherein the rotor interacts with the two stationary contacts so as to close or open a circuit.

Figure 1B:
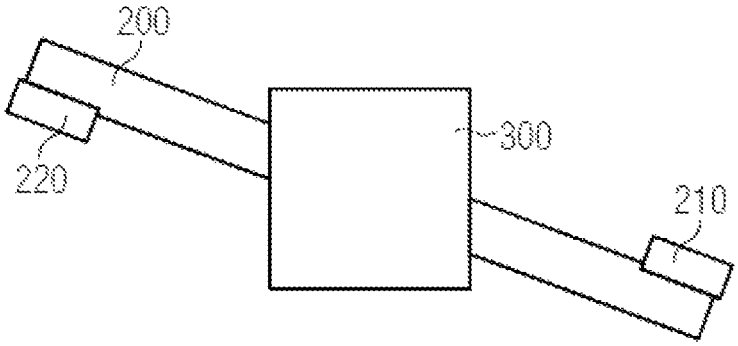
Figure 1C:
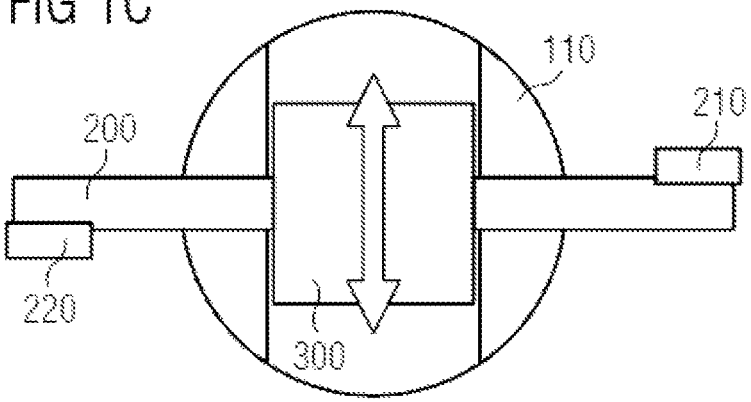

FIGS. 1A, 1B and 1C illustrate a rotor housing 110 for an electric switch and a rotatably mounted contact link 200, which comprises two movable contacts 210, 220. By rotation of the rotor or the rotor housing 110, the two movable contacts 210, 220 can interact with two stationary contacts of an electric switch so as to close or open a circuit. The rotatably mounted contact link 200 is mounted movably in the rotor housing 110 in a direction perpendicular to the direction of the contact link 200 in its closing position. Corresponding to FIG. 1C, this means that the rotatably mounted contact link 200 is arranged movably in the rotor housing 110 in the direction of the arrow.

The rotatably mounted contact link 200 can be mounted in a suspension device 300, which in turn is mounted movably in the rotor housing 110.

The rotatably mounted contact link 200 is likewise mounted movably in the rotor housing 110 in a direction perpendicular to the rotary spindle of the contact link 200.

Figure 2:
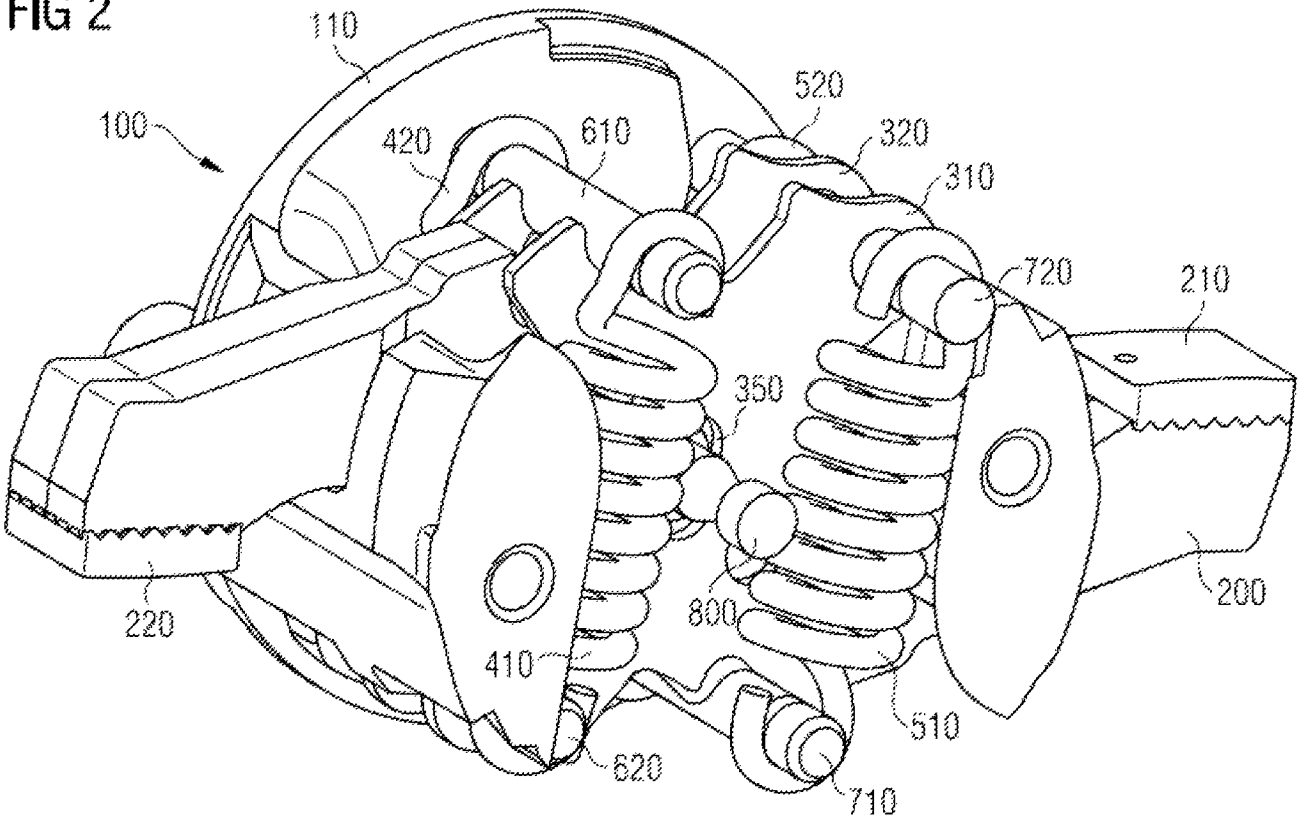
FIG. 2 shows rotor with contact link, two plates, two pairs of first and second spring pins and two pairs of first and second springs.

FIG. 2 illustrates a rotor 100 for an electric switch. The rotor 100 comprises a rotor housing 110 and a rotatably mounted contact link 200. Two movable contacts 210, 220 are fitted on the contact link 200. By rotation of the rotor 100, the two movable contacts 210, 220 can interact with two stationary contacts 2100, 2200 of an electric switch so as to close or open a circuit.

The rotor 100 furthermore comprises a first and a second plate 310, 320, which are located in the interior of the rotor 100 and are arranged substantially parallel to the contact link 200. The rotatably mounted contact link 200 is arranged between these two plates 310, 320. The suspension mechanism of the contact link 200 in the rotor 100 will be explained in more detail below.

The rotor 100 comprises, for this purpose, two pairs of first and second spring pins 610, 710; 620, 720 and two pairs of first and second springs 410, 420; 510, 520. The first ends of the respective spring pairs 410, 420; 510, 520 are fastened on the first spring pins 610, 710. These first spring pins 610, 710 rest on the contact link 200 and likewise on the first and second plates 310, 320. The second ends of the respective spring pairs 410, 420; 510, 520 are fastened on the second spring pins 620, 720. These in turn are fastened on the plates 310, 320, with the result that, in the closing position of the rotor 100, a minimum contact pressure of the movable contacts 210, 220 of the contact link 200 on the stationary contacts 2100, 2200 is ensured.

The rotatably mounted contact link 200 is rotated in the counterclockwise direction, corresponding to the illustration in FIG. 2, by virtue of the first and second spring pairs 410, 420; 510, 520 being drawn onto the first spring pins 610, 710. Thus, for example, the movable contact 220 is moved downwards and the movable contact 210 is moved upwards, corresponding to the illustration in FIG. 2, and as a result a minimum contact pressure on the stationary contacts is ensured.

The second spring pins 620, 720, which are fastened on the first and second plates 310, 320, are mounted movably in the rotor 100.

Figure 3:
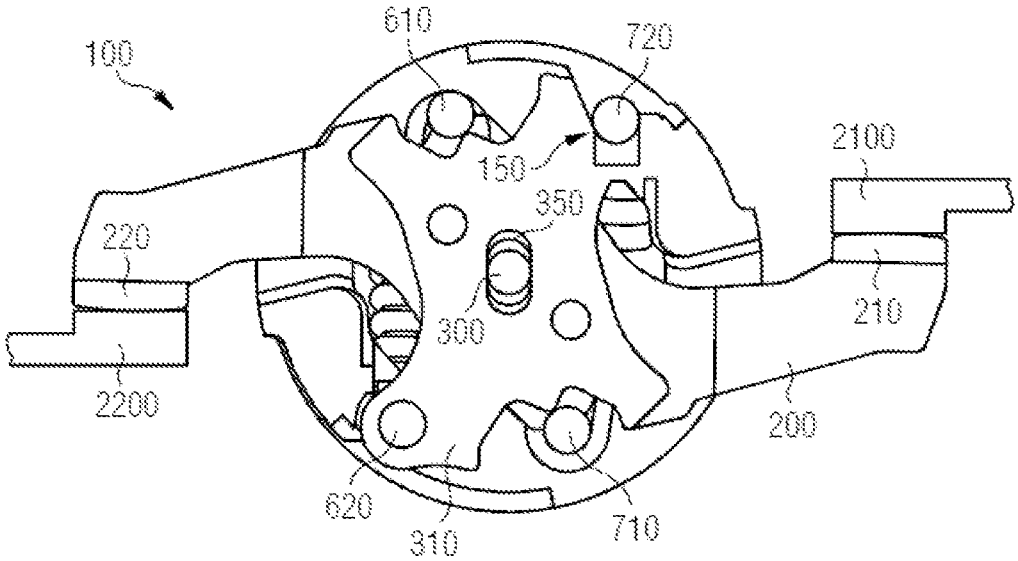
FIG. 3 shows rotor shown in FIG. 1 in a lateral illustration.

In FIG. 3, the movable mounting of the second spring pins 620, 720 is explained in more detail. The second spring pins 620, 720 are each mounted in a notch 150 in the rotor 100. Together with the mounting of the contact link 200 in the electric switch by virtue of the guide pin 800, which is guided through a central cutout 350 in the two first and second plates 310, 320 and the contact link 200, the notches 150 make it possible for the contact link 200 to be movable in the closing position, perpendicular to this direction. Corresponding to the illustration in FIG. 3, this means that the contact link 200 can move upwards and downwards with the movable contacts 210, 220 and as a result can compensate for tolerances, for example in the contact pieces of the contact link 200.

The central cutout 350 is in the form of a slot, which is formed along a direction perpendicular to the direction of the contact link 200 in the closing position.

Figure 4:
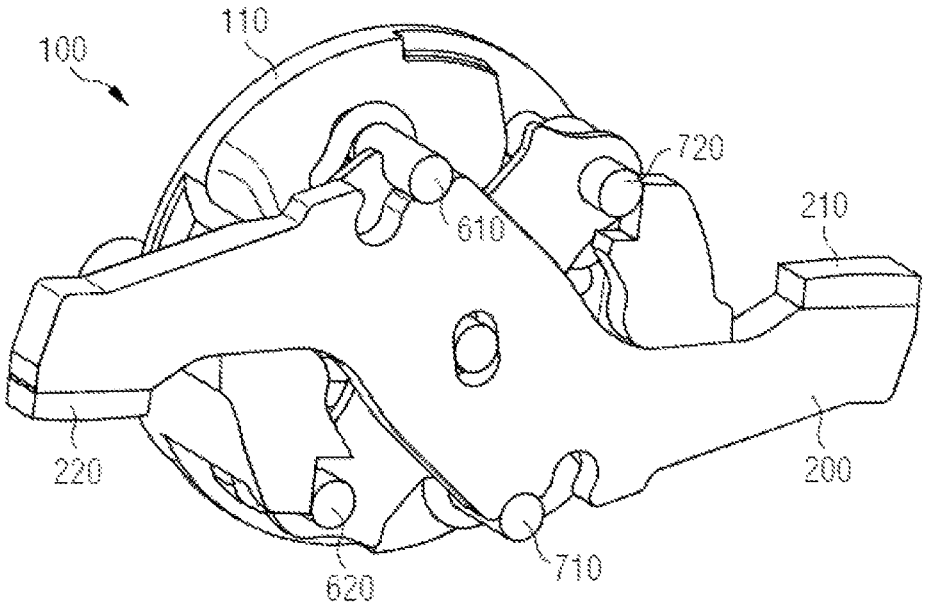
FIG. 4 shows rotor shown in FIG. 1 in a first illustration.
Figure 5:
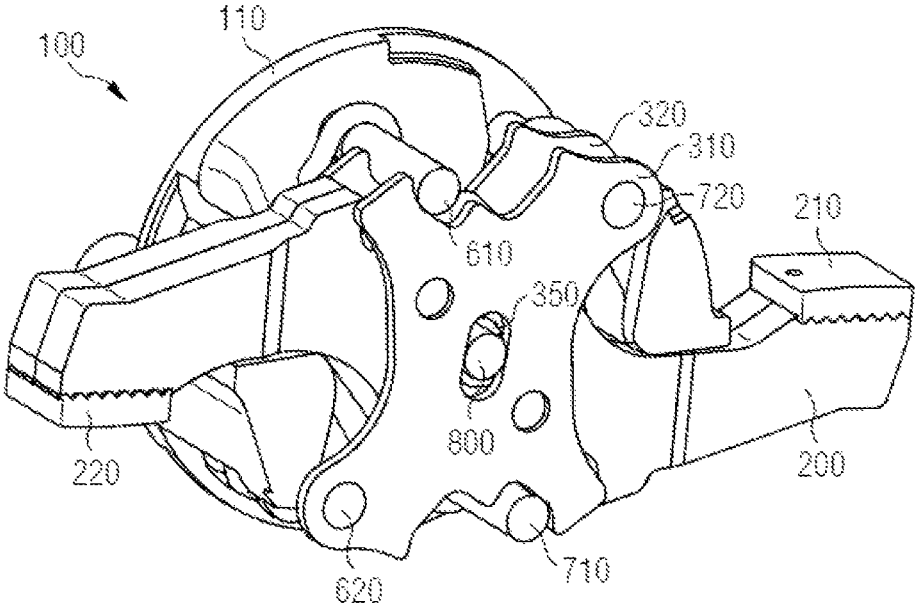
FIG. 5 shows rotor shown in FIG. 1 in a second illustration.

FIG. 4 illustrates the rotor 100 comprising the contact link 200 and the first and second spring pins 610, 710; 620, 720. FIG. 5 shows the rotor 100 in a sectional illustration different than that in FIG. 2, 3 or 4.

Figure 6:
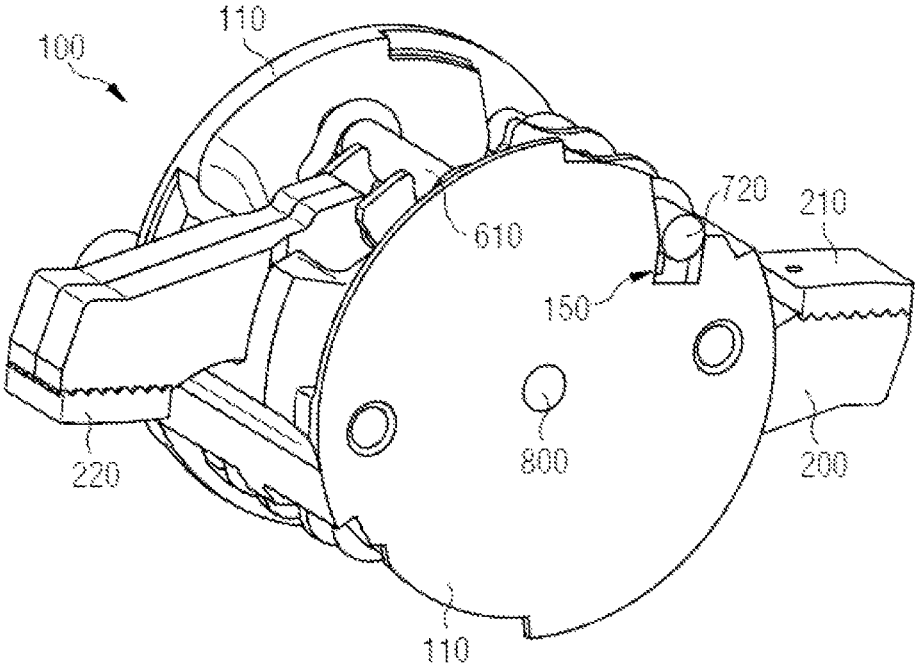
FIG. 6 shows rotor shown in FIG. 1 in a third illustration.

FIG. 6 once again shows the rotor 100 with the notch 150 in the rotor, which notch makes it possible for the contact link 200 to be mounted movably, together with the two plates 310, 320, in the rotor 100. The second spring pins 620, 720 are therefore mounted in floating fashion in the rotor 100. As a result, again likewise the two plates 310, 320 are mounted in floating fashion in the rotor 100.

The two pairs of first and second springs 410, 420; 510, 520 are in the form of tension springs in this exemplary embodiment. The pairs of first and second springs 410, 420; 510, 520 pass from the first spring pins 610, 710 to the second spring pins 620, 720 parallel to the two plates 310, 320. Corresponding to the embodiment illustrated, the first and second springs 410, 420; 510, 520 pass outside the two plates 310, 320.

Figure 7:
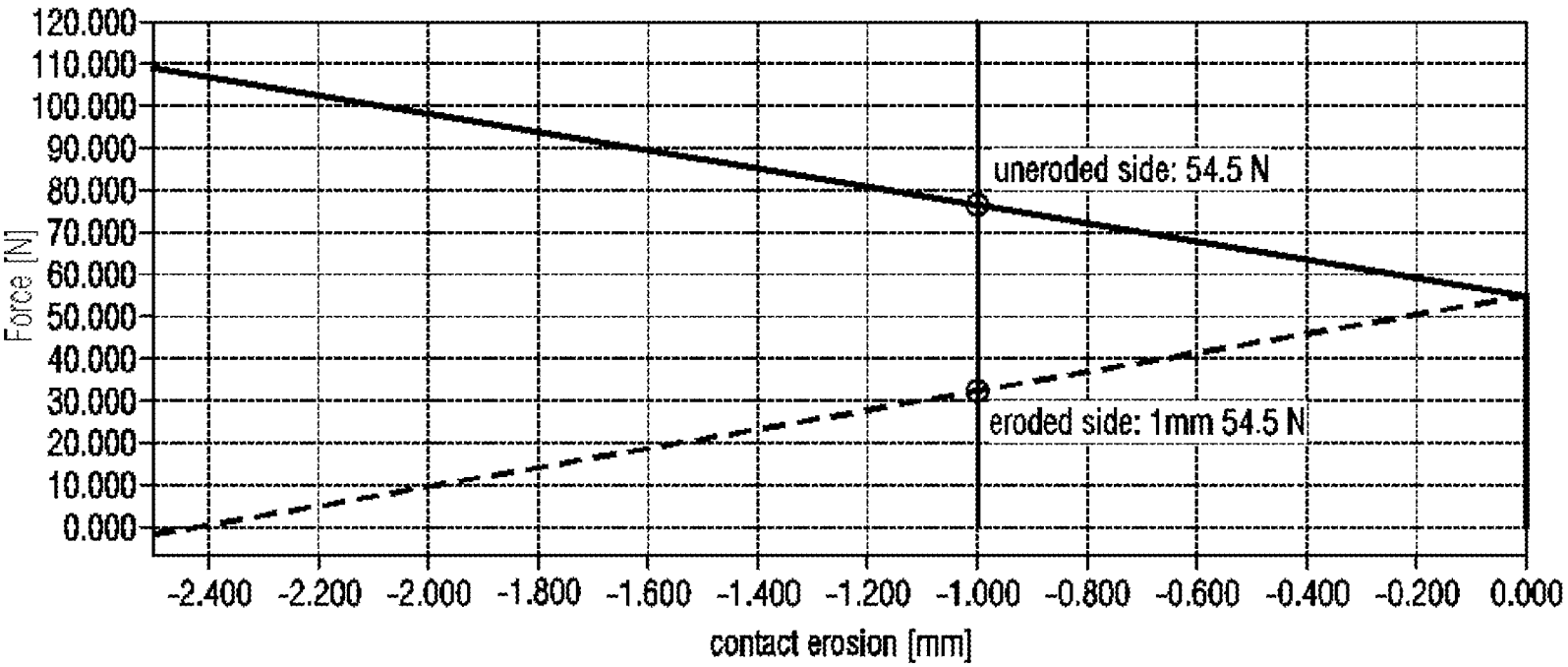
FIG. 7 shows a force/erosion graph of a rotor according to an embodiment of the invention.

FIG. 7 illustrates a force/erosion graph. By virtue of the fact that the second spring pins 620, 720 which are mounted in floating fashion enable a movement of the rotatably mounted contact link 200, irrespective of the degree of erosion of the contact pieces an identical contact force is set at the two movable contacts 210, 220.

Figure 8A:
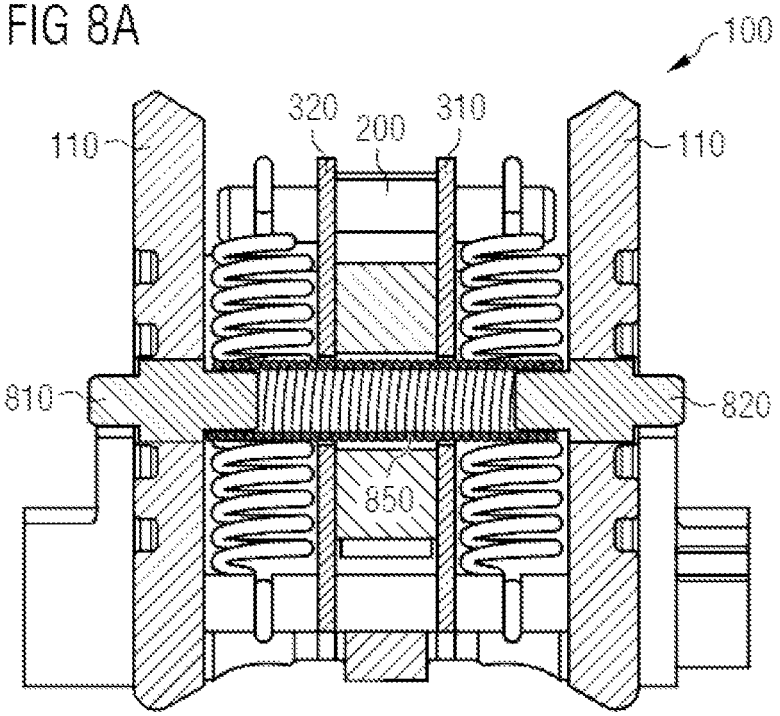
FIGS. 8A and 8B show rotor housing, contact link and guide pin comprising first and second rotor pin and centering spring and integrally formed centering pin.

FIG. 8A illustrates the first and second plates 310, 320 and the guide pin 800, which comprises a first rotor pin 810, a second rotor pin 820 and a centering spring 850. The centering spring 850 is guided through the central cutout 350 in the contact link 200 and holds the contact link 200. Corresponding to the illustration in FIG. 8A, the first rotor pin 810 is held in the left-hand part of the rotor housing 110, and the second rotor pin 820 is held in the right-hand part of the rotor housing 110.

The centering spring 850 passes between the two rotor pins 810; 820. It is in the form of a tension spring comprising a coiled spring body without any spring eyelets. Other designs, for example with a flexible, sprung plastic, can likewise be used, and the flexibility of the spring body in the upwards/downwards direction corresponding to the illustration in FIG. 8A and FIG. 8B so as to match the mounting and center the contact link 200 should be provided by the centering spring 850.

The spring constant of the centering spring 850 should be designed such that the centering spring 850 can support the mass of the contact link 200 so as to center the contact link in the rotor housing 110. When designing the spring constant, sagging of the centering spring 850 owing to the weight of the contact link 200 with the corresponding attachments such as the two plates 310; 320 and the spring pairs 410, 420; 510, 520 should therefore be avoided.

Likewise, the spring constant of the centering spring 850 should be designed such that the centering spring 850 does not provide a high degree of force in opposition to compensation of asymmetry of the contact link 200. The centering spring 850 should therefore not be too rigid.

Figure 8B:
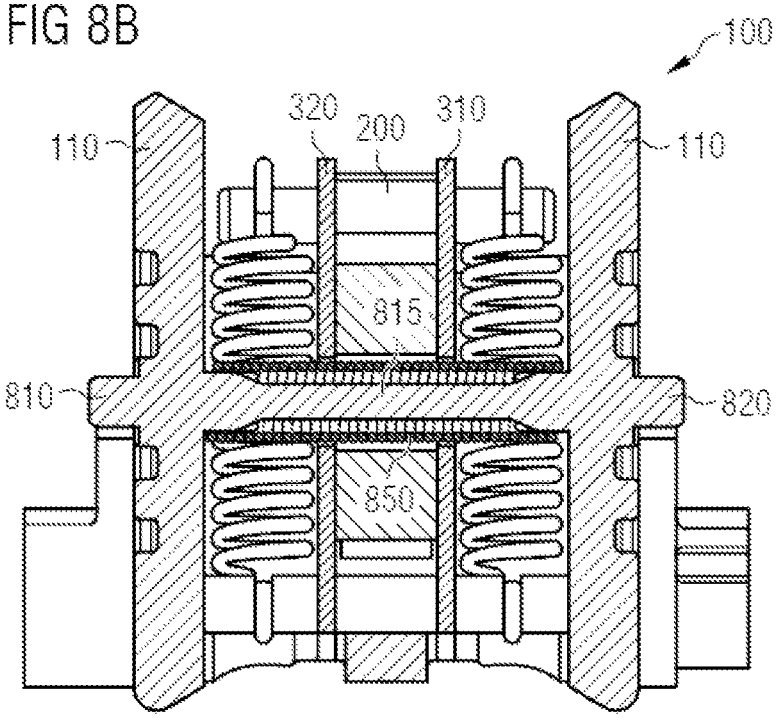

FIG. 8B illustrates an alternative configuration in which the first rotor pin 810 and the second rotor pin 820 are connected to one another via a fixed central part 815. The first rotor pin 810, the second rotor pin 820 and the fixed central part 815 are formed integrally in this case.

The diameter of the centering spring 850 is so great in comparison with the diameter of the fixed central part 815 that the contact link 200 held by the centering spring 850 can effect compensation of asymmetry of the contact link 200 until the centering spring 850 stops against the central part 815. The gap between the centering spring 850 and the central part 815 can be adapted in terms of its magnitude such that there is sufficient distance available for the asymmetry compensation but a stop does not arise when the central part 815 is reached by the centering spring 850.

Figure 9A:
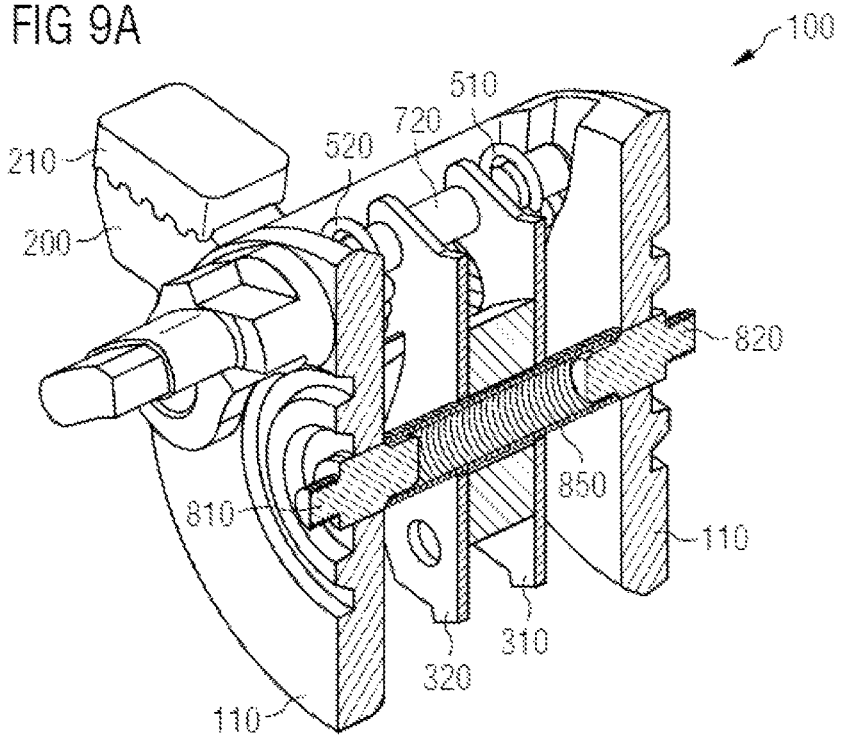
FIGS. 9A and 9B show a lateral view of a rotor housing, a contact link and a guide pin comprising a first and second rotor pin and a centering spring and integrally formed centering spring.
Figure 9B:
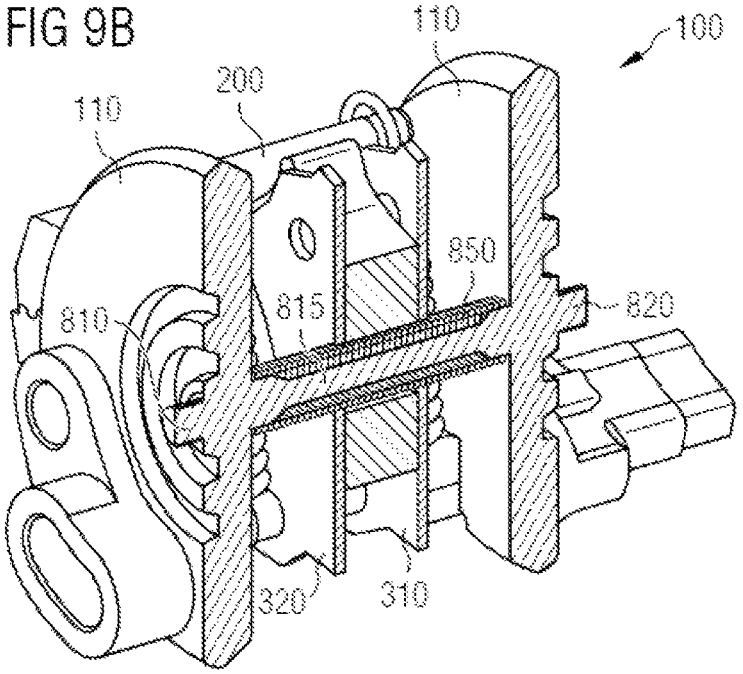

The two embodiments are illustrated further in a side view in FIGS. 9A and 9B. FIG. 9A illustrates the guide pin 800 comprising a first rotor pin 810, a second rotor pin 820 and a centering spring 850. FIG. 9B shows the lateral view of the alternative embodiment with an integral guide pin. The contact link 200 compensates for asymmetries in the design in floating fashion in both embodiments.

Figure 10:
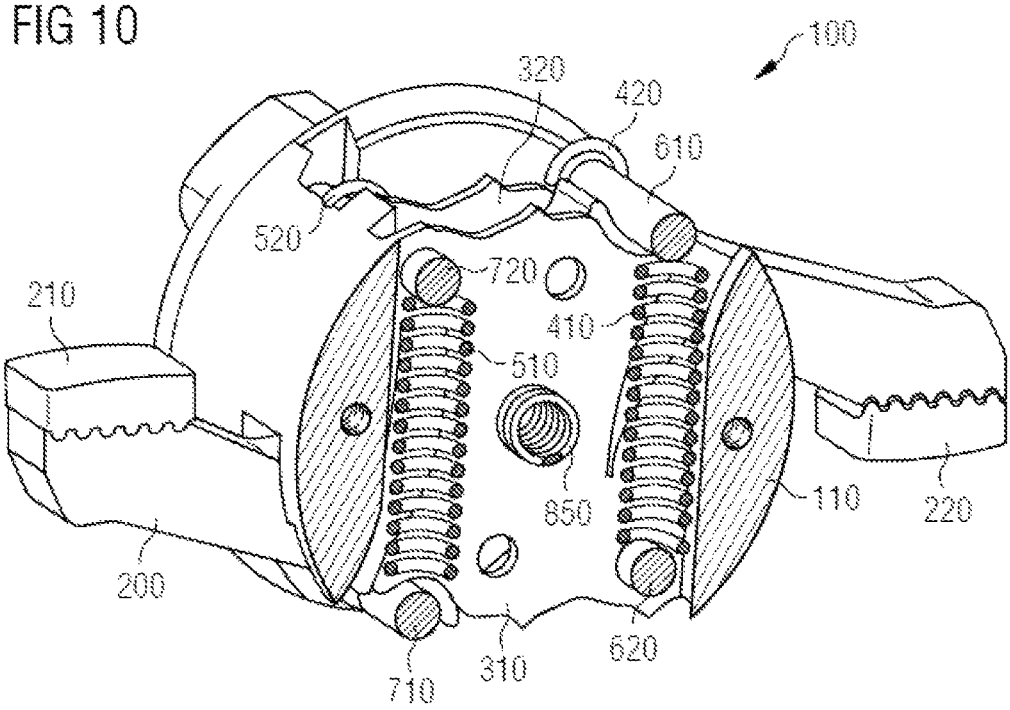
FIG. 10 shows a contact link.

FIG. 10 illustrates the rotor 100 with a first plate 310, a second plate 320, a contact link 200 and a centering spring 850. The contact link 200 has a central cutout, in which the guide pin 800 is inserted. First and second plates 310; 320 and contact link 200 are mounted rotatably about the guide pin 800. Corresponding to the illustration in FIG. 10, only the centering spring 850 of the guide pin 800 is illustrated.

The rotor 100 according to the invention can be part of an electric switch, wherein the switch additionally comprises two stationary contacts 2100, 2200. The rotor 100 with the two movable contacts 210, 220 can interact with the two stationary contacts 2100, 2200 so as to close or open a circuit.

Until now, the contact link has generally been mounted fixed in position in the rotor. Compensation of different spring lengths given different tolerances of the component parts or different lever arms owing to different degrees of erosion of the contacts is compensated for in accordance with the invention via floating mounting of the plates 310; 320, which bear the contact link 200.

By introducing a centering spring which bears the contact link, the plates arranged laterally with respect to the contact link are connected to one another. A stable inner rotor with reduced degrees of freedom is therefore provided. The contact link rotates coaxially about the centering spring and is necessarily moved along with the compensation movement of the inner rotor. Without this coupling, the inevitability and therefore reproducibility of the compensation result is lacking. This means that in the case of rapid switch-on operations of a circuit breaker, the contact link cannot go along with the full compensation movement of the plates and therefore, in system-related fashion, asymmetrical contact forces may arise, for example owing to friction.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rotor for an electric switch, comprising:

a rotor housing;

a rotatably mounted contact link, including two movable contacts, the two movable contacts being, by rotation of the rotor, configured to interact with two stationary contacts of an electric switch so as to close or open a circuit, and the rotatably mounted contact link being movably mounted in the rotor housing in a direction perpendicular to a direction of the contact link in its closing position;

a first plate in an interior of the rotor housing, the first plate being arranged substantially parallel to the contact link;

two pairs of first and second spring pins; and two pairs of first and second springs, wherein first ends of the respective spring pairs are fastened on the first spring pins, wherein the first spring pins rest on the contact link and the first plate, wherein second ends of the respective spring pairs are fastened on the second spring pins, and the second spring pins on the first plate, with the result that, in the closing position of the rotor, a minimum contact pressure of the movable contacts of the contact link on the stationary contacts is ensured, and wherein the second spring pins are movably mounted in the rotor housing.

2. The rotor of claim 1, wherein the rotatably mounted contact link is mounted movably in the rotor housing in a direction perpendicular to a rotary spindle of the contact link.

3. The rotor of claim 1, further comprising:

a second plate in an interior of the rotor housing, the second plate being arranged substantially parallel to the contact link and to the first plate, wherein the first spring pins rest on the contact link and the first and second plates, and wherein the second ends of the respective spring pairs are fastened on the second spring pins and the second spring pins on the first and second plates.

4. The rotor of claim 1, wherein the two pairs of first and second springs are in the form of tension springs.

5. The rotor of claim 1, wherein the two plates and the contact link include a central cutout, through which a guide pin, acting as rotary spindle of the rotor, is guided.

6. The rotor of claim 1, wherein the guide pin acts as a rotary spindle of the rotor and comprises a first rotor pin, a second rotor pin and a centering spring.

7. The rotor of claim 6, wherein the first rotor pin and the second rotor pin are connected to the rotor housing, and the centering spring passes between the two rotor pins.

8. The rotor of claim 7, wherein the contact link is held by the centering spring.

9. The rotor of claim 6, wherein the centering spring is in the form of a tension spring with a coiled spring body without any spring eyelets.

10. The rotor of claim 9, wherein a spring constant of the centering spring is designed in to support a mass of the contact link in order to center the contact link in the rotor housing.

11. The rotor of claim 10, wherein the spring constant of the centering spring is designed such the centering spring does not provide a high degree of force in opposition to asymmetry balancing of the contact link.

12. The rotor of claim 6, wherein the first rotor pin and the second rotor pin are connected to one another via a fixed central part.

13. The rotor of claim 12, wherein a diameter of the centering spring is so great in comparison with the diameter of the fixed central part that the contact link held by the centering spring effects asymmetry balancing of the contact link until the centering spring stops against the central part.

14. The rotor of claim 12, wherein the first rotor pin, the second rotor pin and the fixed central part are formed integrally.

15. An electric switch, comprising:

the rotor of claim 1; and two stationary contacts, wherein the rotor is configured to interact with the two stationary contacts so as to close or open a circuit.

16. The rotor of claim 3, wherein the two pairs of first and second springs are in the form of tension springs.

17. The rotor of claim 3, wherein the two plates and the contact link include a central cutout, through which a guide pin, acting as rotary spindle of the rotor, is guided.

18. The rotor of claim 13, wherein the first rotor pin, the second rotor pin and the fixed central part are formed integrally.

19. An electric switch, comprising:

the rotor of claim 6; and two stationary contacts, wherein the rotor is configured to interact with the two stationary contacts so as to close or open a circuit.

* * * * *